US008277690B2

(12) United States Patent
Dhawan et al.

(10) Patent No.: US 8,277,690 B2
(45) Date of Patent: Oct. 2, 2012

(54) CONDUCTING COPOLYMER FERROMAGNETIC COMPOSITE AND A PROCESS FOR THE PREPARATION THEREOF

(75) Inventors: Sundeep Kumar Dhawan, New Delhi (IN); Kuldeep Singh, New Delhi (IN); Nikhil Sobti, New Delhi (IN); Anil Ohlan, New Delhi (IN); Parveen Saini, New Delhi (IN); Beena Gupta, New Delhi (IN); Rajendra Prasad Pant, New Delhi (IN); Ravinder Kumar Kotnala, New Delhi (IN); Kishan Hari, New Delhi (IN); Prafulla Chandra Kothari, New Delhi (IN)

(73) Assignee: Council of Scientific & Industrial Research, New Delhi (IN)

( * ) Notice: Subject to any disclaimer, the term of this patent is extended or adjusted under 35 U.S.C. 154(b) by 179 days.

(21) Appl. No.: 12/434,753

(22) Filed: May 4, 2009

(65) Prior Publication Data

US 2009/0302263 A1 Dec. 10, 2009

(30) Foreign Application Priority Data

Jun. 9, 2008 (IN) ..... 1362/DEL/2008

(51) Int. Cl.
*H01B 1/08* (2006.01)
*H01F 1/01* (2006.01)

(52) U.S. Cl. ..... 252/500; 252/62.56; 528/210

(58) Field of Classification Search ..... 252/500, 252/518.1, 62.56; 528/210, 422, 486
See application file for complete search history.

(56) References Cited

U.S. PATENT DOCUMENTS

| | | | | |
|---|---|---|---|---|
| 4,604,229 | A | 8/1986 | Raj et al. | |
| 5,264,157 | A | 11/1993 | Bidan et al. | |
| 5,471,185 | A | 11/1995 | Shea et al. | |
| 5,938,979 | A * | 8/1999 | Kambe et al. | 252/500 |
| 6,764,617 | B1 | 7/2004 | Viswanathan et al. | |
| 6,919,063 | B2 | 7/2005 | Jang et al. | |
| 6,919,158 | B2 | 7/2005 | Kawamura et al. | |
| 6,927,666 | B2 | 8/2005 | Ahn et al. | |
| 7,193,021 | B2 * | 3/2007 | Xiao et al. | 525/535 |

OTHER PUBLICATIONS

Ohlan et al "Conducting Feromagnetic Copolymer of Aniline and 3,4-ethylenedioxythiophene containing nanocrystalline barium ferrite particles", Journal of Applied Polymer Science, vol. 108, 2218-2225 (Feb. 6, 2008).*

Wan, M. and Li, J.; "A composite of polyaniline with both conducting and ferromagnetic functions," Polymer Science (1997) 2129-2136.

Wan, M., Zhou, W. and Li, J.; "Composite of polyaniline containing iron oxide with nanometer size has been synthesized by a chemical method," Synthetic Metals 78 (1996) 27-31.

(Continued)

*Primary Examiner* — Mark Kopec

(74) *Attorney, Agent, or Firm* — Edwards Wildman Palmer LLP; Barry Kramer; Nicholas J. DiCeglie, Jr.

(57) ABSTRACT

The present invention provides a conducting copolymer ferromagnetic composite. Particularly, the present invention relates to a conducting copolymer of aniline and ethylenedioxy thiophene containing ferrite particles. The present invention also provides insitu polymerization of aniline and ethylene-dioxy thiophene in the presence of ferrite particles and suitable surfactant medium. This conducting copolymer ferromagnetic composite can be used for the dissipation of electrostatic charge, for the shielding of electromagnetic interference and as absorbing of electromagnetic waves in the microwave region.

12 Claims, 7 Drawing Sheets

OTHER PUBLICATIONS

Poddar, P., Wilson, J.L., and Srikanth, H.; "Magnetic properties of conducting polymer doped with manganese—zinc ferrite nanoparticles," (NRL, USA)—Nanotechnology 15 (2004) S 570-74.

Coronado, E.; "Coexistence of ferromagnetism and metallic conductivity in a molecule based layered compound," Nature 408(6811):447-9, 2000.

Cai, L.T., Yao, S.B. and Zhou, S.M.; "Improved Conductivity and Electrical Properties of Polyaniline in the presence of rare earth cations and magnetic field," Synthetic Metals, 88 (1997) 205-208.

Kawai, T., Okazaki, S., Mizobuchi, H., Araki, H. and Yoshino, K.; "Novel ferromagnetic behaviour of conducting polymers doped with fullerene and TDAE," Synthetic Metals, 86 (1997) 2333-34.

L.K. Deres and B.S. Tlu'chinskiy; "Method of Obtaining Current-Conducting Polymeric Materials," Foreign Technology Div. Wright-Patterson AFB OH, Report Date: May 21, 1991, Report number: A9102923.

Kazantseva, N.E.; "Magnetic behaviour of composites containing polyaniline coated manganese zinc ferrite," J. of Magnetism & Magnetic Materials, 269 (2004) 30-37.

Li, G., Yan, S., Zhou, E. and Chen, Y.; "Preparation of magnetic and conductive NiZn ferrite-polyaniline nanocomposites." Colloids & Surfaces A: Physicochem (2005).

* cited by examiner

CONDUCTING COPOLYMER FERROMAGNETIC COMPOSITE AND A PROCESS FOR THE PREPARATION THEREOF

CROSS-REFERENCE TO RELATED APPLICATIONS

This application claims benefit of priority to Indian Patent Application No. 1362/DEL/2008, filed Jun. 9, 2008, which is incorporated by reference herein in its entirety.

FIELD OF THE INVENTION

The present invention relates to a conducting copolymer ferromagnetic composite. Particularly, the present invention relates to a conducting copolymer of aniline and ethylene-dioxy thiophene containing ferrite particles. The present invention also relates to insitu polymerization of aniline and ethylene-dioxy thiophene in the presence of ferrite particles and suitable surfactant medium. This conducting copolymer ferromagnetic composite can be used for the dissipation of electrostatic charge, for the shielding of electromagnetic interference and as microwave absorbing material in the microwave region.

BACKGROUND OF THE INVENTION

Conducting polymers have emerged as important class of electronic materials because of their potential and wide applications in energy storage systems, opto-electronic devices, organic light emitting diodes, sensors for hazardous gases and toxic fumes, corrosion inhibitors for iron and mild steel and EMI shielding in radio frequency range and microwave range. The study of the conducting polymers is a sub field of the larger, older field organic electrical conductors, which had already started in early 1970's, with the discovery of (SN)x. These organic materials possess electronic conductivity comparable to metals and semiconductors. The conducting polymer, polyacetylene, has electronic conductivity of the order of $10^5$ S/cm whereas the conductivity of copper is $10^6$ S/cm. With the idea that electronic conductivity can be varied with doping has revolutionized the area of research. They acquire importance over inorganic semiconductors in their application because of their high strength to weight ratio, toughness, low cost and ease of processing into film. The prospect of plastic metals has inspired much interest in these materials for technological applications such as antistatic coatings and electromagnetic interference shielding and in other areas where light weight, flexibility and high conductivity materials are required.

Among conducting polymers, polyaniline and its analogues have been widely studied due to its ease of protonic acid doping in the emeraldine form and its environmental stability in both doped and undoped forms. Conducting polymer, polyaniline, exists in various forms and each form find technological application. The fully reduced form of polyaniline is leucoemeraldine, which finds applications in Li-polyaniline battery and electrochromic devices. 50% reduced and 50% oxidized form of polyaniline is termed as emeraldine base, which is the insulating form of polyaniline. It finds application in sensors for HCl gas and as corrosion protective coating on iron and mild steel. Doping of emeraldine form leads to the formation of conducting polyaniline, which is used as an electrode material in batteries, sensors, EMI shielding and electrochromic devices. The fully oxidized form of polyaniline is pernigraniline, which find applications in non-linear optics. Conductivity in polyaniline depends on the degree of protonation of the material.

The polymerization of aniline to polyaniline in the presence of organic protonic acids like p-toluene sulphonic acid, dodecylbenzene sulphonic acid and aerosol OT may bring certain changes in the properties of polyaniline because conduction mechanism in polyaniline involves protonation as well as ingress of counter anions to maintain charge neutrality. Protonation and electron transfer in polyaniline leads to the formation of radical cations by an internal redox reaction, which causes the reorganization of electronic structure to give two semiquinone radical cations. In the doping process, ingress of anions occurs to maintain charge neutrality in the resultant doped polyaniline matrix. This implies that nature of anions should influence the properties of the resulting polyaniline. This is the reason why polyaniline doped with inorganic dopants like $Cl^-$ and $SO_4^{2-}$ are thermally less stable than the polyaniline doped with organic dopants like p-toluene sulphonate or dodecylbenzenesulphonate.

Doping of polyaniline with organic protonic acids can be carried out by direct method in which a monomer is polymerized in the presence of organic protonic acid or by indirect method in which emeraldine base is doped with desired organic acid. In both the methods, the dopant is attached with polyaniline. However, the polymer obtained by all these techniques had only electrical conductivity and does not have any magnetic behaviour. In this direction, worldwide researchers are employing different techniques to incorporate magnetic constituents in the polymer backbone so that the resultant polymer possesses both electrical and magnetic properties. However, by introducing ferrite constituents, the resultant polymers obtained possess less conductivity or the magnetization value obtained had less values. By insitu polymerization of monomers in the ferrite medium, we observed that the resultant polymers possesses both electrical conductivity and good magnetization value of the order from 35 to 48.9 emu/gm. The patentibility of the present invention is based on these observations.

Earlier different attempts were made by researchers like making blends with ferrofluids or by blending ferrites in the polymer matrix.

U.S. Pat. No. 5,264,157 relates to the synthesis of an electrically conducting polymer poly pyrrole having magnetic properties. In this, composite material has been prepared by the polymerization of monomer, pyrrole in the presence of a colloidal suspension of charged magnetic particles like ferrofluids.

U.S. Pat. No. 4,604,229 describes a method of preparing ferrofluid composition in a ferrofluid seal apparatus comprising a liquid carrier having a colloidal dispersion of ferromagnetic particles in an amount sufficient to provide magnetic properties to the ferrofluid composition and carbon particles stabilized in the ferrofluid composition by a surface active dispersing agent.

U.S. Pat. No. 6,919,158 provides a method of providing a conductive pattern forming material by which a fine pattern having a high resolution is obtained.

U.S. Pat. No. 6,764,617 claim a formation of conductive ferromagnetic composition comprising sulfonated lignin or a sulfonated polyflavonid or derivatives thereof and ferromagnetic iron oxide particles. The invention provides a conducting ferromagnetic material consisting of iron oxide materials and a conducting polymer comprising lignosulfonic acid doped polyaniline.

U.S. Pat. No. 6,927,666 reports the fabrication of a inductor which comprises a magnetic core that occupies substantially the entire volume enclosed by the conductive coil where the substrate comprises Si, SiC, Ge etc. and magnetic core comprises ferromagnetic material deposited by chemical vapour deposition.

A composite of polyaniline with both conducting and ferromagnetic functions has been reported by Wan and Li, J. Polymer Science (1997) 2129-2136 where the composite of polyaniline has been prepared by varying the concentrations of $FeSO_4$ where a maximum magnetization value, Ms, of 20 emu/g has been observed but the composite show insulating behaviour.

U.S. Pat. No. 5,471,185 (November 1995) reports the electrical circuit protection devices comprising conductive liquid compositions. The invention provides an electrical circuit protection device using a conductive liquid contained in flexible tube contacted and sealed at each end by an annular metal electrode capped by a Flexible membrane. The flexible tube is further sealed inside a solid insulating tube, which contains a ferromagnetic liquid. The conducting liquid has a resistivity of about 1 to 2000 milliohm-cm.

Composite of polyaniline containing iron oxide with nanometer size has been synthesized by a chemical method as reported in Synthetic Metals 78 (1996) 27-31 by M. Wan, W. Zhou and J. Li. For the basic preparation conditions (e.g. pH 14), the resulting PANI-FexOy composite can be attracted by a magnet and its magnetization with the applied magnetic field exhibits a hystersis loop with a Hc=0. However the electrical conductivity of the composite is $10^{-4}$ S/cm with a saturation magnetization value of the order of 20 emu/gm.

Magnetic properties of conducting polymer doped with manganese-zinc ferrite nanoparticles has been reported by P. Poddar, J. L. Wilson, H. Srikanth (NRL, USA)-Nanotechnology 15 (2004) S 570-74. The magnetic properties of super paramagnetic particles are influenced by the supporting matrix. A study of the DC magnetic properties of loosely packed manganese-zinc ferrite synthesized using reverse micelle technique were embedded in polypyrrole matrix.

Coexistence of ferromagnetism and metallic conductivity in a molecule based layered compound has been reported by E. Coronado in Nature 408(6811):447-9, 2000. They have synthesized single crystals of a compound composed of layers od BEDT-TTF interleaved with layers of Mn—Cr Oxalate. When positively charged BEDT-TTF has semiconductor properties and their charge balances the negative charge of Mn—Cr-Oxalate. In this Mn is in oxidation state II and Cr in state III and these provide a two dimesional array with ferromagnetic behaviour. The conductivity at room temperature reaches a value of ~250 S/cm having Ms value of 7.

Improved Conductivity and Electrical Properties of Polyaniline in the presence of rare earth cations and magnetic field has been discussed by L. T. Cai, S. B. Yao & S. M. Zhou in the Synthetic Metals, 88 (1997) 205-208. The influence of rare earth cations on the preparation and properties of polyaniline was investigated. The existence of paramagnetic ions can greatly increase the can greatly increase the effects of magnetic alignment. The conductivity of PANI/Tb3+/Bp=0.7 T was 115.4 S/cm.

U.S. Pat. No. 6,919,063 (July 2005) reports a method of preparing Carbon nanoparticles and transparent conductive polymer composite containing the same. The present invention relates to a novel Carbon nano particle and a novel method of preparing the same and a conductive polymer composite containing the same. Decyltrimethylammonium bromide was added to pyrrole with oxidant $FeCl_3$ added into the reactor. PPy nano particles were then moved into electric furnace and then heated to about 900° C. under $N_2$ environment with the heating rate of 3° C./minute. The electrical conductivity of the present composite is 16×10−4 S/cm and magnetic anisotropic coefficient of the order of $2.4\times10^8$ ergs/$cm^3$.

Novel ferromagnetic behaviour of conducting polymers doped with fullerene and TDAE has been reported in Synthetic Metals, 86 (1997) 2333-34. Magnetic behaviour of composites of $C_{60}$ and some soluble conducting polymers such as poly(3-alkylthiophene) and poly(2,5-dioctyloxyphenylene) has been studied by ESR measurements. Spin-susceptibility depends upon temperature markedly. Dependence of magnetic behaviour on the thermal treatment and molecular structure of host conducting polymer is given.

Method of Obtaining Polymeric Current-Conducting Material has been reported by V. Ye. Gul, N. F. Shchibrya, Foreign Technology Div. Wright-Patterson AFB OH, Report Date: 26 OCT 90, Report number: A921332. Methods of obtaining isotropic polymeric current-conducting materials by introduction to polymer of ferromagnetic filler with after hardening in magnetic field are given. The dispersion of ferromagnetic filler for the bonding agents used are 45.6 d of nickel of carbonyl, 46.7 d 23% solution of the partially saponified copolymer of vinyl acetate with the vinyl chloride of brand A 15-0 in the mixture of organic solvents, 7.7 g DGU (50% solution of diethyleneglycolurethane in cyclohexanone).

Magnetic behaviour of composites containing polyaniline coated manganese zinc ferrite has been reported by N. E. Kazantseva in J. of Magnetism & Magnetic Materials, 269 (2004) 30-37. Polycrystalline Mn—Zn ferrite has been coated with PANI doped with picric acid, which is embedded into a polyurethane matrix. The coated ferrite particles had a conductivity of 0.34 S/cm. The paper provides only Ms value of ferrite, which is 3.5 kGs.

Preparation of magnetic and conductive NiZn ferrite-polyaniline nanocomposites by G. Li, S. Yan, E. Zhou, Y. Chen has been reported in Colloids & Surfaces A: Physicochem (2005). Magnetic & conductive NiZn ferrite nanocomposites with core shell structure have been fabricated by micro emulsion process. Ms value of NiZn ferrite was observed to be 5.84 emu/gm whereas for the composite Ms observed is 0.76 emu/gm. The conductivity of the composite is 0.094 S/cm.

OBJECTIVES OF THE INVENTION

The main objective of the present invention is to provide a conducting copolymer ferromagnetic composite.

Yet another objective is to provide a conducting copolymer of aniline and ethylene-dioxy thiophene containing ferrite particles.

Yet another objective is to provide a process for the preparation of conducting copolymer of aniline and ethylene-dioxy thiophene containing ferrite particles.

Yet another objective is to provide insitu polymerization of aniline and ethylene-dioxy thiophene in the presence of ferrite particles and suitable surfactant medium.

SUMMARY OF THE INVENTION

Accordingly the present invention provides a conducting copolymer ferromagnetic composite comprising a copolymer of aniline or substituted aniline and ethylene-dioxy thiophene, containing ferrite particles.

In an embodiment of the present invention the substituted aniline used is selected from the group consisting of o-toluidine, o-anisidine, o-ethyl aniline, o-phenetidine, isopropyl aniline, secondary butyl aniline and 2-acetyl aniline.

In yet another embodiment the ferrite particle used is selected from the group consisting of gamma-ferric oxide, barium ferrite and cobalt ferrite.

In yet another embodiment the conducting ferromagnetic composite has the following characteristics:

I. magnetization value up to 48.9 emu/gm,

II. conductivity of the order of 1.0 S/cm and

III. stability up to a temperature of 240-260° C.

The present invention further provides a process for the preparation of conducting copolymer ferromagnetic composite comprising the steps of:

i) homogenizing the ferrite particles in surfactant medium, in the presence of aniline or substituted aniline and ethylene-dioxy thiophene, under stirring, ii) adding an aqueous solution of oxidant slowly drop by drop to the above said solution mixture obtained in step (i), at a temperature in a range of −5 to 5° C. and stirring the resultant reaction mixture, for a period of 4-6 hours, iii) filtering the above said reaction mixture, followed by washing with isopropanol, and drying the polymer composite, at a temperature in a range of 50-60° C., under vacuum to obtain the desired product.

In yet another embodiment the ferrite particle used in the process is selected from the group consisting of gamma-ferric oxide, barium ferrite and cobalt ferrite.

In yet another embodiment the substituted aniline used in the process is selected from the group consisting of o-toluidine, o-anisidine, o-ethyl aniline, o-phenetidine, isopropyl aniline, secondary butyl aniline and 2-acetyl aniline.

In yet another embodiment the concentration of aniline or substituted aniline and ethylene-dioxy thiophene used in the process is in the range of 0.1 M to 1.0 M.

In yet another embodiment the oxidant used in the process is selected from the group consisting of ammonium peroxydisulphate, potassium peroxydisulphate, potassium monopersulphate, ferric p-toluene sulphonate and ferric dodecylbenzene sulphonate.

In yet another embodiment the concentration of oxidant used in the process is in the range of 0.01 M to 0.1 M.

In yet another embodiment the surfactant used in the process is selected from the group consisting of dodecylbenzene sulphonic acid, cardanol sulphonic acid and aerosol OT acid.

In yet another embodiment the concentration of the surfactant used in the process is in the range of 0.1 M to 0.3 M.

In still another embodiment the conducting copolymer composite obtained by said process has the following characteristics:

a) magnetization value up to 48.9 emu/gm, b) conductivity of the order of 1.0 S/cm and c) stability up to a temperature of 240-260° C.

DETAIL DESCRIPTION OF THE INVENTION

The present invention provides a conducting copolymer ferrite composite, which comprises insitu polymerization of monomers with the ferrite constituent embedded in the surfactant matrix. The monomers aniline and its analogues like o-anisidine, o-toluidine, o-phenetidine, o-ethyl aniline, isopropyl aniline, butyl aniline and ethylenedioxy thiophene (EDOT) may be in a ratio of in a range of 0.01 mole to 0.1 mole. The ferrite particles incorporated in the polymer matrix are $\gamma$-$Fe_2O_3$, $Fe_3O_4$, barium ferrite, cobalt ferrite. The surfactant attached to ferrite particles are dodecylbenzene sulphonic acid, aerosol OT, cardanol sulphonic acid and the like. In yet another embodiment of the present invention the surfactant to ferrite constituent ratio may be in a range of 1:0.1 to 0.5. The concentration of monomer taken is from 0.01 to 0.1 moles.

The oxidant used in the present invention is ammonium peroxydisulphate, potassium peroxydisulphate, potassium monopersulphate, ferric p-toluene sulphonate, ferric dodecylbenzene sulphonate.

The process of preparation of conducting ferrite composite is described herewith. Ferrite particles and surfactant molecules are homogenized in a reaction vessel with a homogenizer and then monomer is added in the vessel and mixed thoroughly. In this reaction mixture drop wise aqueous solution of an oxidant is added. The oxidant may be ammonium peroxydisulphate, potassium peroxydisulphate, potassium monopersulphate, ferric p-toluene sulphonate, ferric dodecylbenzene sulphonate and the like. The reaction mixture is stirred preferably for 6 hours, till a greenish brown precipitate of polymer is obtained. The mixture is filtered and washed thoroughly with distilled water, till the colour of the filtrate is colourless. The precipitate so obtained is vacuum dried at about 55° C.

The novelty of the present invention is the preparation of conducting polymer possessing both electrical and magnetic properties having magnetization value up to 48.9 emu/gm and a conductivity of the order of 1.0 S/cm. A further novelty of the invention lies in the application of these composites for EMI shielding studies in the microwave range. Both these novelties are realized due to the inventive step of preparation of insitu polymerization of aniline in the presence ferrite embedded in surfactant matrix.

Figure 1:
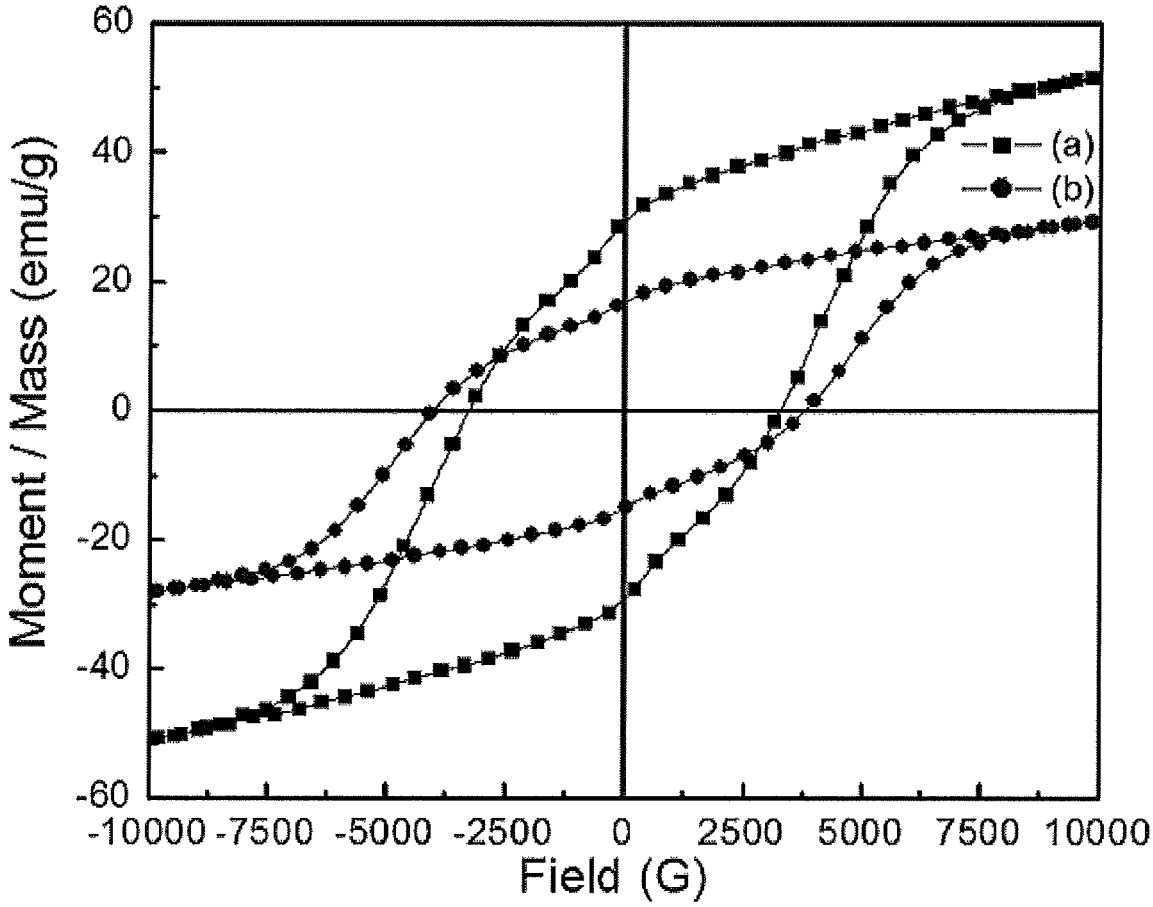
FIG. 1 represents the VSM data of barium ferrite nano particles (a) and conducting copolymer of aniline and EDOT-barium ferrite composite (b)
Figure 2:
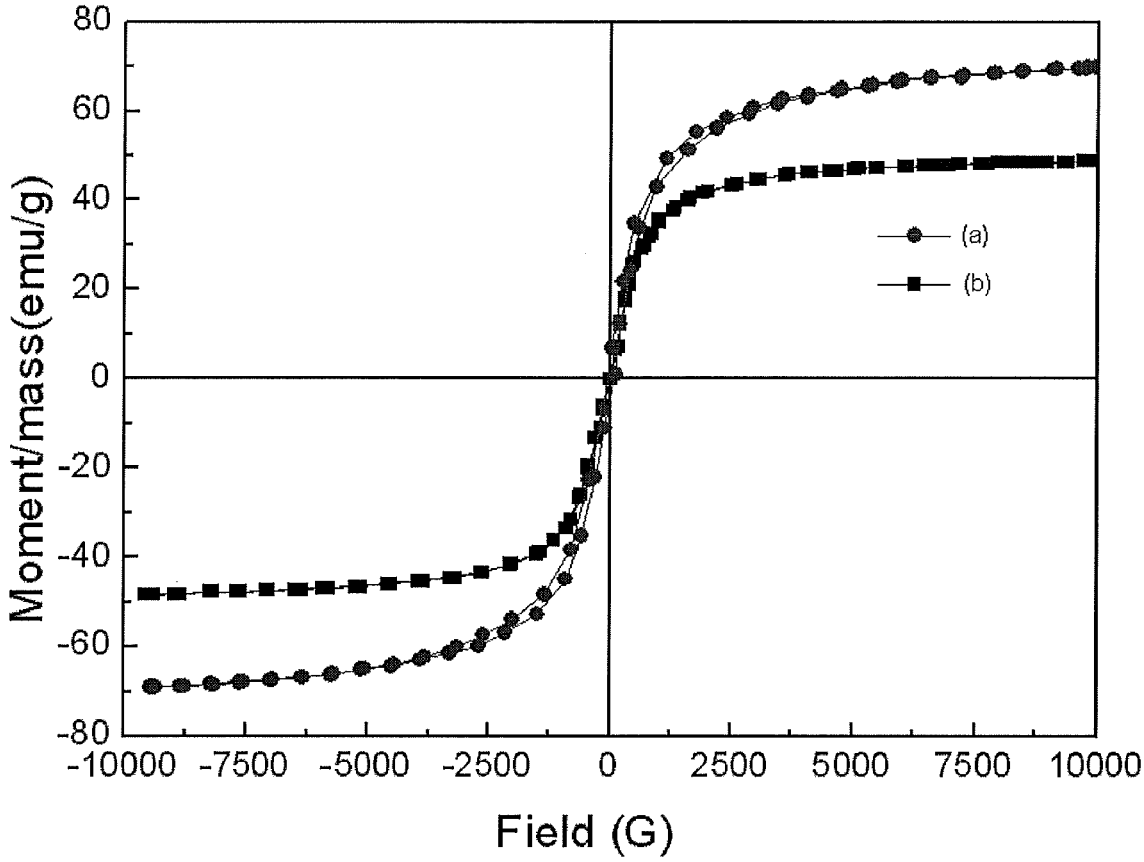
FIG. 2 represents VSM data of γ-Fe2O3 nano particles (a) and conducting polymer PANI-γ-Fe2O3 composite (b)
Figure 3:
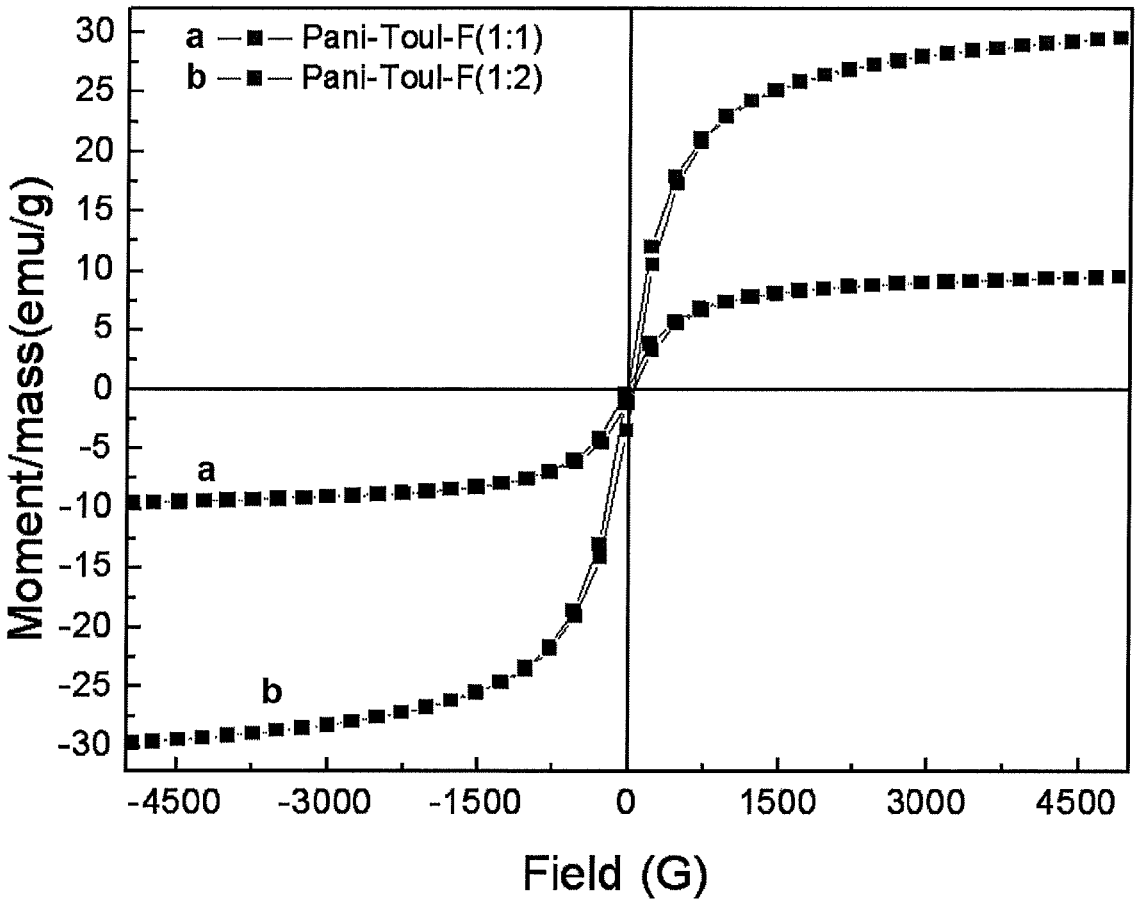
FIG. 3 represents VSM data of copolymer of (An+Tol)-ferrite composite (a) and conducting copolymer of (An+Tol)-$\gamma$-$Fe_2O_3$ composite (b)
Figure 4:
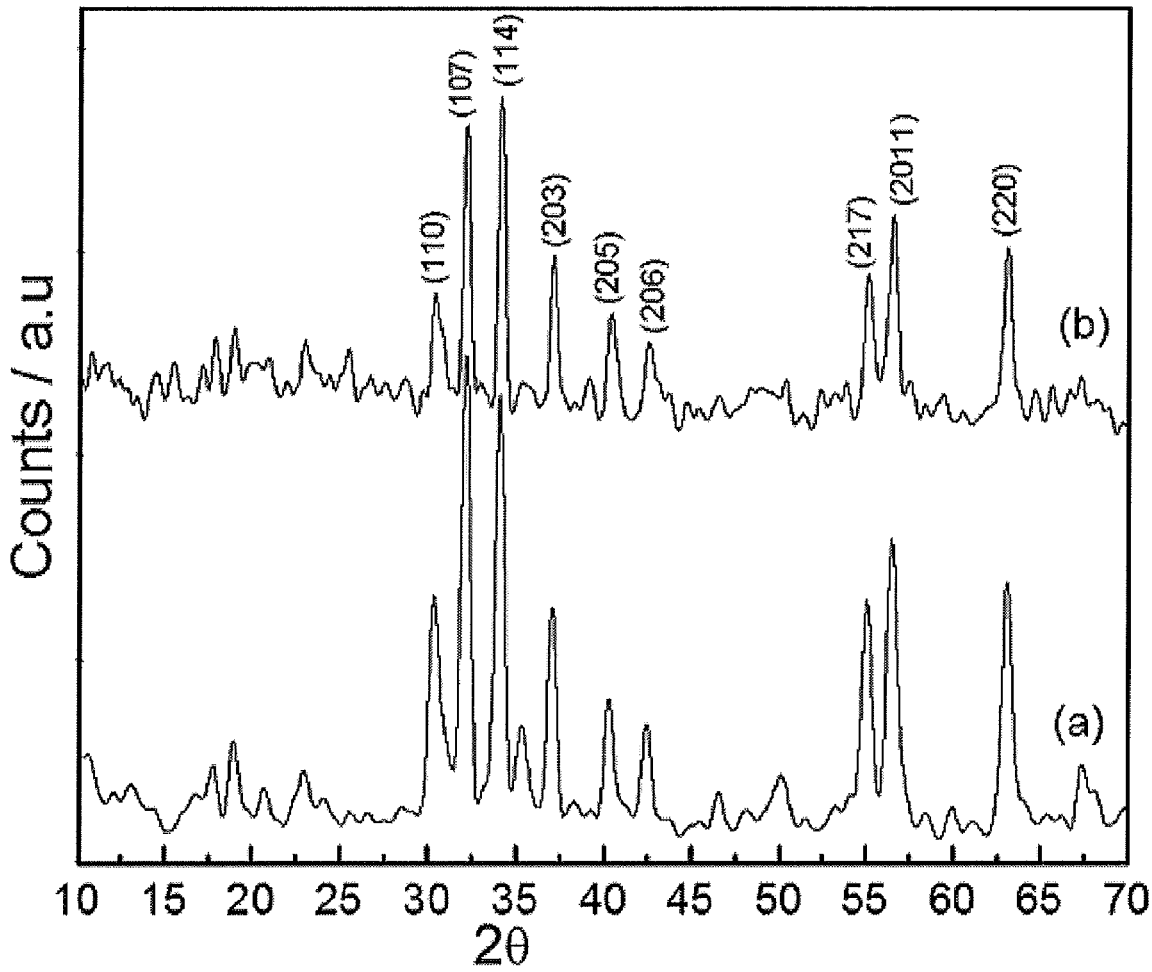
FIG. 4 represents XRD data of Copolymer of aniline and EDOT with barium ferrite; (a) BaF (b) Poly (An-EDOT)-BaF
Figure 5:
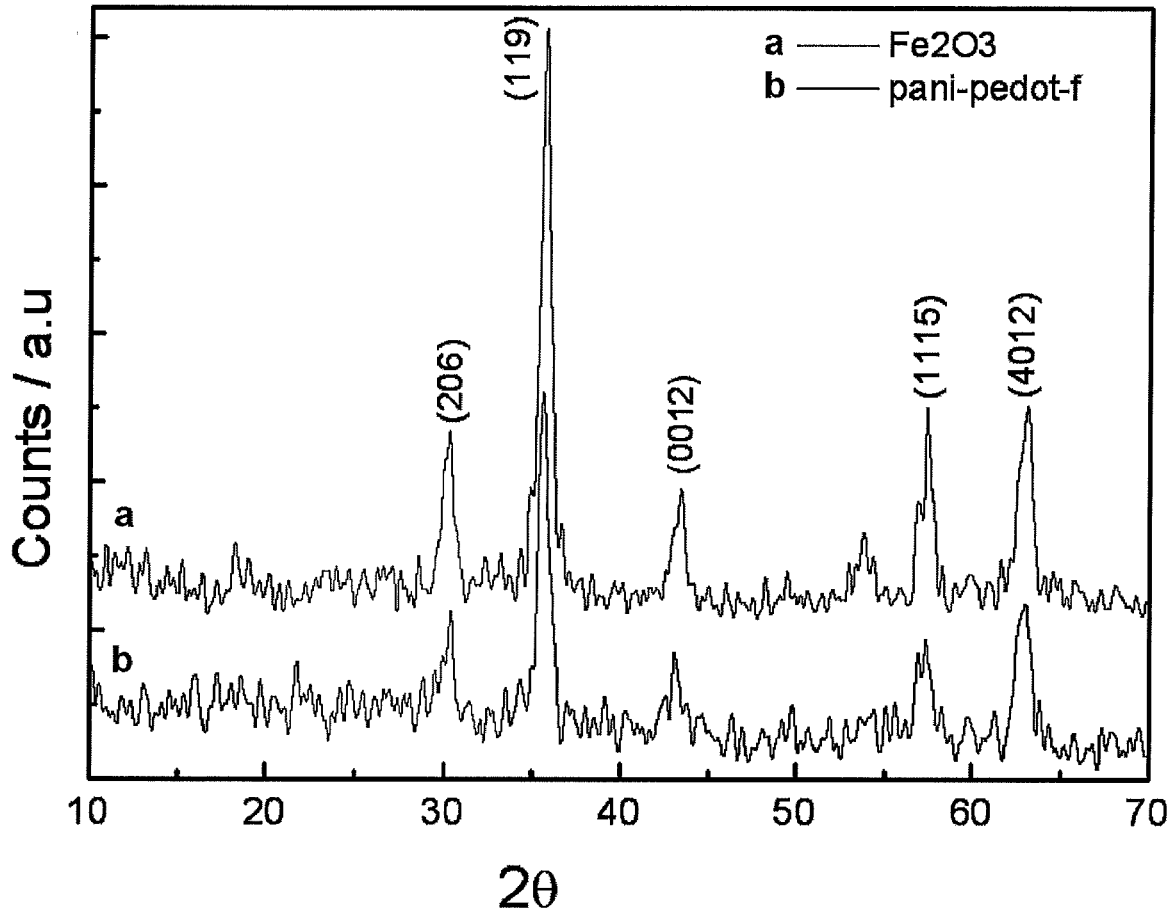
FIG. 5 represents the XRD pattern of the conducting copolymer-$\gamma$-$Fe_2O_3$ composite
Figure 6:
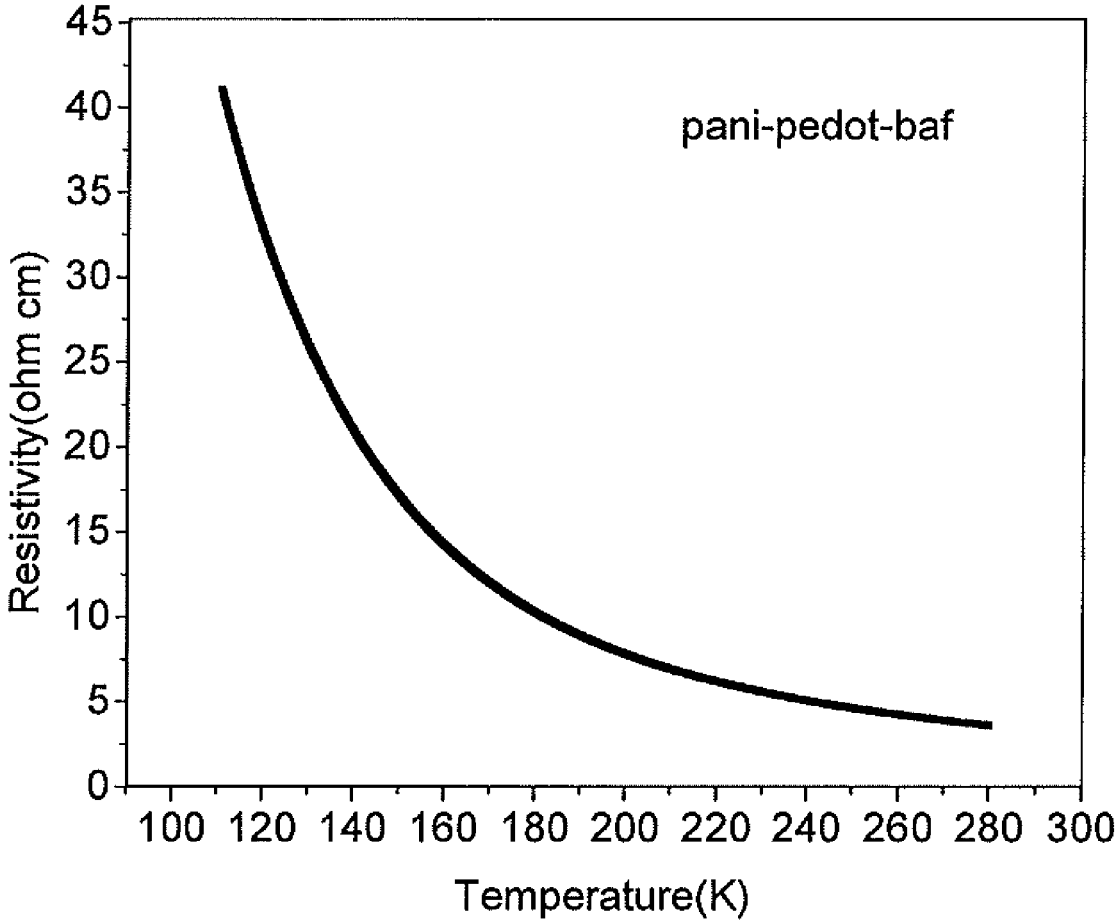
FIG. 6 represents the resistivity temperature data of conducting copolymer (An-EDOT) BaF composites
Figure 7:
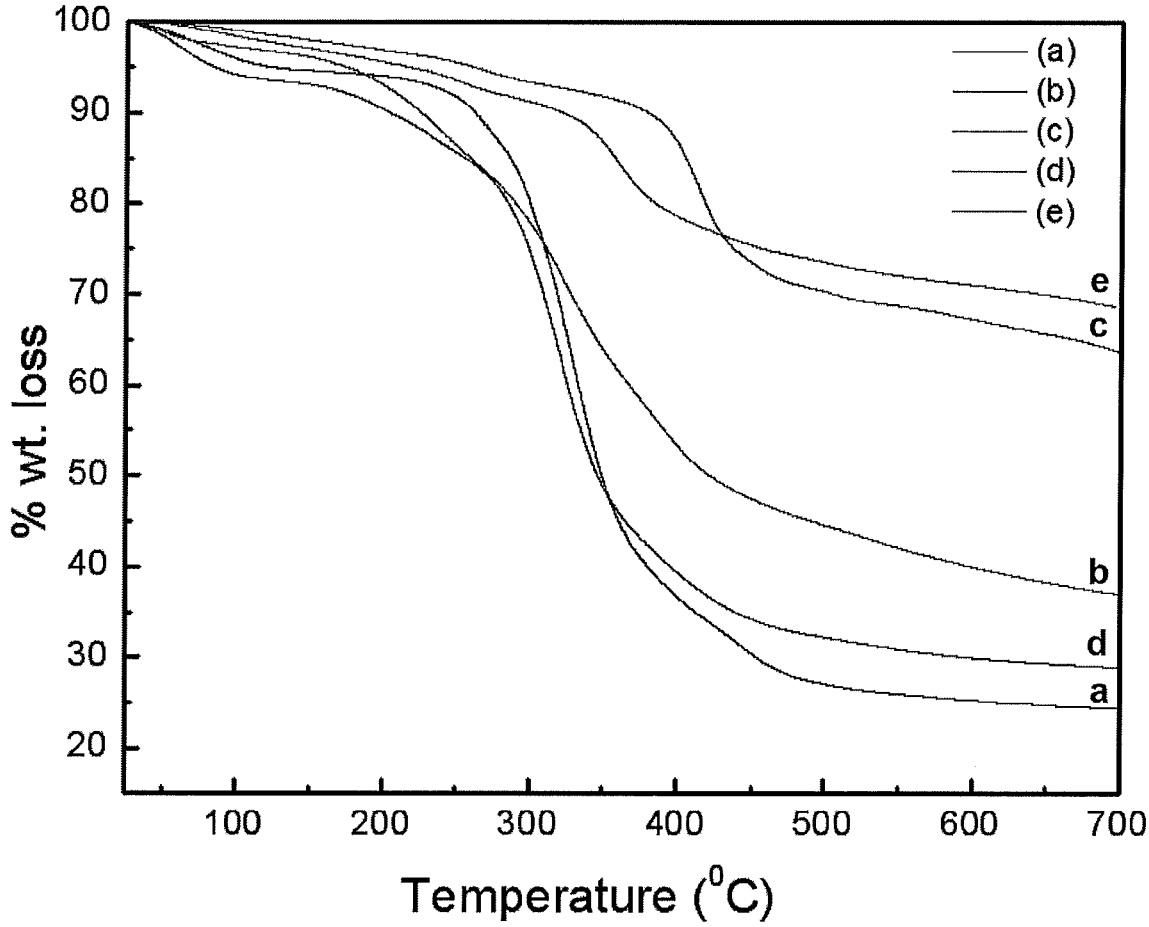
FIG. 7 represents the Thermogravimetric analysis data of polyaniline (curve a); PEDOT (curve b); poly(AnEDOT) (curve c), poly(AnEDOT)-BaF (curve d) and poly (AnEDOT)-$\gamma$-$Fe_2O_3$ (curve e) at a scan rate of 10° C./min under $N_2$.

The following examples are given to illustrate the process of the present invention and should not be construed to limit the scope of the present invention.

EXAMPLE 1

Synthesis of Copoly(EDOT-AN)-Barium Ferrite (BaF) Composite

The synthesis of copolymer complex is carried out by adding barium ferrite into 0.3M solution of DBSA (having 1:2 weight ratio of monomers to ferrites) which is homogenized for 2 h for the homogenous dispersion of ferrite particles in the surfactant solution. To this reaction mixture, 0.05M EDOT and 0.05M aniline is added, again homogenized for 2 hours and polymerized using ammonium peroxydisulphate. After 8 hrs of stirring, blue green precipitate of copolymer embedded with barium ferrite (Poly (AnEDOT)-BaF) was obtained. The precipitate so obtained is mixed thoroughly with iso-propanol, filtered and dried at 60° C. in oven and dried samples are crushed in pastor mortar and ball mill to use them for further characterization. The polymer so obtained was characterized by FTIR, XRD, UV-visible and magnetic and electrical properties were measured with VSM and 4-probe method.

EXAMPLE 2

The synthesis of copolymer complex of aniline and ethylenedioxythiophene with ferric oxide particles was carried out by taking 0.05 M of aniline and 0.05 M of ethylenedioxythiophene in an homogenized mixture of gamma ferric oxide and dodecylbenzene sulphonic acid and polymerizing it with ammonium peroxydisulphate in a double walled reactor at a temperature of 0° C. The polymerization reaction is carried out for 8 hours with continuous stirring. Bluish green precipitate of copolymer embedded with ferric oxide particles (Poly (AnEDOT)-$\gamma$-$Fe_2O_3$) are obtained. The precipitate so obtained is mixed thoroughly with iso-propanol, filtered and dried at 60° C. in oven and dried samples are crushed in pastor mortar and ball mill to use them for further characterization. The polymer so obtained was characterized by FTIR, XRD, UV-visible and magnetic and electrical properties were measured with VSM and 4-probe method.

EXAMPLE 3

0.1 mole of ethylene dioxythiophene containing barium ferrite in the weight ratio of 1:1 embedded with DBSA are taken in a double walled reaction vessel and is kept at 0° C. The reaction mixture is stirred and drop wise aqueous solution of 0.1 M oxidant, ammonium peroxydisulphate, is added. The reaction mixture is stirred for 6 hours, till a dark bluish brown precipitate of polymer is obtained. The mixture is filtered after de-emulsification with iso-propanol. The precipitate so obtained is vacuum dried at 50° C. The polymer so obtained was characterized by FTIR, XRD, UV-visible and magnetic and electrical properties were measured with VSM and 4-probe method.

EXAMPLE 4

0.5 weight ratio of ferric oxide ferrite particles were homogenized with DBSA in a homogenizer at an rpm of 10,500 for 60 minutes and to this 0.1 mole of aniline is added and the reaction mixture is further homogenized. The above reaction mixture is taken in a double walled reaction vessel and is kept at 0° C. The reaction mixture is stirred and drop wise aqueous solution of 0.1 M oxidant, ammonium peroxydisulphate, is added. The reaction mixture is stirred for 6 hours, till a dark greenish brown precipitate of polymer is obtained. De-emulsification of the above precipitate is done with iso-propanol and is filtered. The precipitate so obtained is vacuum dried at 50° C. The polymer so obtained was characterized by FTIR, XRD, UV-visible and magnetic and electrical properties were measured with VSM and 4-probe method.

EXAMPLE 5

0.1 M of aniline containing ferric oxide ferrite particles in a weight ratio of 2:1 embedded with DBSA are taken in a double walled reaction vessel and is kept at 0° C. The reaction mixture is stirred and drop wise aqueous solution of 0.1 M oxidant, ammonium peroxydisulphate, is added. The reaction mixture is stirred for 6 hours, till a dark greenish brown precipitate of polymer is obtained. The mixture is filtered after de-emulsification with iso-propanol. The precipitate so obtained is vacuum dried at 50° C.

EXAMPLE 6

0.1 M of aniline containing barium ferrite particles in a weight ratio of 1:1 embedded with DBSA are taken in a double walled reaction vessel and is kept at 0° C. The reaction mixture is stirred and drop wise aqueous solution of 0.1 M oxidant, ammonium peroxydisulphate, is added. The reaction mixture is stirred for 6 hours, till a dark greenish brown precipitate of polymer is obtained. The mixture is filtered before de-emulsification with iso-propanol. The precipitate so obtained is vacuum dried at 50° C.

EXAMPLE 7

0.1 M of toluidine containing ferrite particles in a weight ratio of 1:1 embedded with DBSA are taken in a double walled reaction vessel and is kept at 0° C. The reaction mixture is stirred and drop wise aqueous solution of 0.1 M oxidant, ammonium peroxydisulphate, is added. The reaction mixture is stirred for 6 hours, till a dark greenish brown precipitate of polymer is obtained. The mixture is filtered after de-emulsification with iso-propanol. The precipitate so obtained is vacuum dried at 50° C.

EXAMPLE 8

0.1 mole of aniline containing ferric oxide particles in a weight ratio of 1:1 embedded with DBSA are taken in a double walled reaction vessel and is kept at 0° C. The reaction mixture is stirred and drop wise aqueous solution of 0.1 M oxidant, ferric dodecyl benzene sulphonate, is added. The reaction mixture is stirred for 6 hours, till a dark greenish brown precipitate of polymer is obtained. The mixture is filtered after de-emulsification with iso-propanol. The precipitate so obtained is vacuum dried at 50° C.

Preparation of Barium Ferrite Nano Particles

EXAMPLE 9

Barium ferrite is synthesized by precursor route using barium nitrate $Ba(NO_3)_2$, ferric nitrate $Fe(NO_3)_3.9H_2O$ and citric acid in a molar ratio of 1:12:13 in deionised water and dissolving in ammonia solution by maintaining the pH at 9.0. The above solution is heated to 90° C. with continuous stirring. After evaporating all the water, the viscous gel formed is dried at 100° C. after which the dry material is ignited in air. The above precursor is calcined at 900° C. for four hours resulting in the formation of brown barium ferrite powder ($BaFe_{12}O_{19}$). The powder so obtained is further grinded using high-energy planetary ball mill. The resulting barium ferrites particles were analyzed with X-ray diffraction and VSM analysis before proceeding further for blending with conducting polymers Preparation of Ferric Oxide Ferrite Particles

EXAMPLE 10

Aqueous solutions of 0.025 M $FeCl_2$ and 0.05 M $FeCl_3$ were homogenized in a homogenizer for 30 minutes. To the above solution, 1.0 M of aqueous ammonia was added and stirring continued for further 30 minutes till a brown precipitate is formed. The above precipitate was filtered and washed thoroughly with distilled water and dried under vacuum at different temperatures ranging from 60-180° C. The resulting ferrites particles were analyzed with X-ray diffraction and VSM analysis before proceeding further for blending with conducting polymers.

Advantages:

The conducting copolymer composite possess both electrical and magnetic properties having magnetization value from 30 emu/gm to 48.9 emu/gm and conductivity of the order of 0.1 to 1.0 S/cm. This conducting copolymer ferromagnetic composite can be used for the dissipation of electrostatic charge, for the shielding of electromagnetic interference and as absorbing of electromagnetic waves in the microwave region.

We claim:

1. A conducting copolymer ferromagnetic composite comprising a copolymer of aniline or substituted aniline and ethylene-dioxy thiophene, containing ferrite particles, wherein the conducting ferromagnetic composite has the following characteristics:

I. magnetization value up to 48.9 emu/gm,

II. conductivity of the order of 1.0 S/cm, and

III. stability up to a temperature of 240-260° C.

2. The conducting ferromagnetic composite as claimed in claim 1, wherein the substituted aniline used is selected from the group consisting of o-toluidine, o-anisidine, o-ethyl aniline, o-phenetidine, isopropyl aniline, secondary butyl aniline and 2-acetyl aniline.

3. The conducting ferromagnetic composite as claimed in claim 1, wherein the ferrite particle used is selected from the group consisting of gamma-ferric oxide, barium ferrite and cobalt ferrite.

4. A process for the preparation of conducting copolymer ferromagnetic composite comprising the steps of:

i) homogenizing the ferrite particles in surfactant medium, in the presence of aniline or substituted aniline and ethylene-dioxy thiophene, under stirring;

ii) adding an aqueous solution of oxidant slowly drop by drop to the above said solution mixture as obtained in step (i), at a temperature in a range of −5 to 5° C. and stirring the resultant reaction mixture, for a period of 4-6 hours; and iii) filtering the above said reaction mixture as obtained in step ii), followed by washing with isopropanol, and drying the polymer composite, at a temperature in a range of 50-60° C., under vacuum to obtain the desired product.

5. The process as claimed in claim 4, wherein the ferrite particle used is selected from the group consisting of gamma-ferric oxide, barium ferrite and cobalt ferrite.

6. The process as claimed in claim 4, wherein the substituted aniline used is selected from the group consisting of o-toluidine, o-anisidine, o-ethyl aniline, o-phenetidine, isopropyl aniline, secondary butyl aniline and 2-acetyl aniline.

7. The process as claimed in claim 4, wherein the concentration of aniline or substituted aniline and ethylene-dioxy thiophene used is in the range of 0.1 M to 1.0 M.

8. The process as claimed in claim 4, wherein the oxidant used is selected from the group consisting of ammonium peroxydisulphate, potassium peroxydisulphate, potassium monopersulphate, ferric p-toluene sulphonate and ferric dodecylbenzene sulphonate.

9. The process as claimed in claim 4, wherein the concentration of oxidant used is in the range of 0.01 M to 0.1 M.

10. The process as claimed in claim 4, wherein the surfactant used is selected from the group consisting of dodecylbenzene sulphonic acid, cardanol sulphonic acid and aerosol OT acid.

11. The process as claimed in claim 4, wherein the concentration of the surfactant used is in the range of 0.1 M to 0.3 M.

12. The process as claimed in claim 4, wherein the conducting copolymer composite obtained has the following characteristics:

a) magnetization value up to 48.9 emu/gm, b) conductivity of the order of 1.0 S/cm, and c) stability up to a temperature of 240-260° C.

* * * * *